US008225428B2

(12) United States Patent
Grilliot et al.

(10) Patent No.: US 8,225,428 B2
(45) Date of Patent: Jul. 24, 2012

(54) PROTECTIVE HOOD

(75) Inventors: William L. Grilliot, West Milton, OH (US); Mary I. Grilliot, West Milton, OH (US); William L. Grilliot, Jr., Dayton, OH (US); Patricia K. Waters, Tipp City, OH (US)

(73) Assignee: Honeywell International Inc., Morristown, NJ (US)

( * ) Notice: Subject to any disclaimer, the term of this patent is extended or adjusted under 35 U.S.C. 154(b) by 221 days.

(21) Appl. No.: 12/510,888

(22) Filed: Jul. 28, 2009

(65) Prior Publication Data

US 2010/0031422 A1 Feb. 11, 2010

Related U.S. Application Data

(60) Provisional application No. 61/188,612, filed on Aug. 8, 2008.

(51) Int. Cl.
*A42B 1/04* (2006.01)
*A41B 1/00* (2006.01)
*A62D 5/00* (2006.01)

(52) U.S. Cl. ..... 2/202; 2/458; 2/410; 2/7; 2/8.1; 2/84; 2/206

(58) Field of Classification Search ..... 2/455, 456, 2/457, 458, 410, 7, 8.2, 8.1, 417, 418, 468, 2/84, 171, 171.02–171.04, 171.1, 171.5–171.8
See application file for complete search history.

(56) References Cited

U.S. PATENT DOCUMENTS 1,996,703 A * 4/1935 Giuliano ..... 604/303
2,390,352 A * 12/1945 Bouchard ..... 2/8.1
3,169,252 A * 2/1965 Goldstein ..... 2/203
3,373,447 A * 3/1968 Kim ..... 2/206
3,531,952 A * 10/1970 Chesebro, Jr. ..... 66/171
3,561,010 A * 2/1971 Little ..... 2/173
3,740,767 A * 6/1973 Schuessler ..... 2/173
3,747,124 A * 7/1973 Zientara ..... 2/202
3,789,839 A * 2/1974 Lund et al. ..... 128/201.25
3,838,467 A * 10/1974 Zientara ..... 2/202
4,272,853 A * 6/1981 Schuessler ..... 2/424
4,768,235 A * 9/1988 Webster ..... 2/205
4,932,078 A * 6/1990 Jones et al. ..... 2/70
4,941,211 A * 7/1990 Blutstein ..... 2/202
4,972,520 A 11/1990 Grilliot et al.
5,025,507 A * 6/1991 Kirby ..... 2/206
5,090,054 A 2/1992 Grilliot et al.
5,097,534 A * 3/1992 Viemeister et al. ..... 2/69
5,142,704 A * 9/1992 Viemeister et al. ..... 2/202
5,146,636 A * 9/1992 De La Pena ..... 2/202
5,181,506 A * 1/1993 Tardiff et al. ..... 128/201.22
5,274,850 A * 1/1994 Aldridge ..... 2/84
5,546,604 A * 8/1996 Geller ..... 2/202
5,551,087 A * 9/1996 Blutstein et al. ..... 2/173
5,644,799 A * 7/1997 Armenta et al. ..... 2/209.13
(Continued)

*Primary Examiner* — Bobby Muromoto, Jr.

(74) *Attorney, Agent, or Firm* — Wood, Phillips, Katz, Clark & Mortimer

(57) ABSTRACT

A protective hood for use by a firefighter or other emergency worker. The hood includes a crown portion to cover the top of a wearer's head, the crown portion being made from a material having a primary stretch direction oriented to extend in a transverse, ear-to-ear, direction across the top of a wearer's head; and a lower portion that extends downward from the crown portion, the lower portion being made from a material having a primary stretch direction oriented to extend in a circumferential direction around a wearer's head.

11 Claims, 2 Drawing Sheets

U.S. PATENT DOCUMENTS

| | | | | |
|---|---|---|---|---|
| 5,873,132 | A | 2/1999 | Grilliot et al. | |
| 6,038,700 | A * | 3/2000 | Aldridge et al. | 2/81 |
| 6,578,572 | B2 * | 6/2003 | Tischer et al. | 128/201.25 |
| 6,624,096 | B2 * | 9/2003 | Thomas et al. | 442/181 |
| 6,662,375 | B2 | 12/2003 | Lewis | |
| 6,705,128 | B1 * | 3/2004 | Sciacca | 66/17 |
| 6,829,784 | B2 * | 12/2004 | Austin | 2/7 |
| 7,028,345 | B2 * | 4/2006 | Waldman | 2/468 |
| 7,681,417 | B2 * | 3/2010 | Hagihara et al. | 66/174 |
| 7,823,222 | B2 * | 11/2010 | Grilliot et al. | 2/202 |
| 2001/0037518 | A1 * | 11/2001 | Whitfield | 2/205 |
| 2002/0046752 | A1 * | 4/2002 | Tischer et al. | 128/201.29 |
| 2002/0162161 | A1 * | 11/2002 | Zeiler | 2/456 |
| 2002/0174481 | A1 * | 11/2002 | Tremblay-Lutter et al. | 2/457 |
| 2003/0033657 | A1 * | 2/2003 | Austin | 2/81 |
| 2004/0237178 | A1 * | 12/2004 | Landeros | 2/457 |
| 2004/0259446 | A1 * | 12/2004 | Jain et al. | 442/59 |
| 2005/0160514 | A1 * | 7/2005 | Flaniken | 2/84 |
| 2005/0193472 | A1 * | 9/2005 | Courtney et al. | 2/202 |
| 2005/0241045 | A1 * | 11/2005 | Tolton | 2/84 |
| 2006/0021107 | A1 * | 2/2006 | Grilliot et al. | 2/69 |
| 2006/0102177 | A1 * | 5/2006 | Lewis et al. | 128/201.23 |
| 2006/0130213 | A1 * | 6/2006 | Mickle | 2/202 |
| 2008/0196145 | A1 * | 8/2008 | Grilliot et al. | 2/202 |
| 2008/0196146 | A1 * | 8/2008 | Grilliot et al. | 2/202 |
| 2008/0216218 | A1 * | 9/2008 | McKinney et al. | 2/457 |
| 2009/0025112 | A1 * | 1/2009 | Corsini | 2/7 |
| 2010/0083429 | A1 * | 4/2010 | Carraro | 2/456 |
| 2011/0094020 | A1 * | 4/2011 | Brookman | 2/457 |

* cited by examiner

PROTECTIVE HOOD

CROSS-REFERENCE TO RELATED APPLICATIONS

This application claims the benefit of the filing date of U.S. Provisional Application No. 61/188,612, filed Aug. 8, 2008, which is hereby incorporated by reference.

FEDERALLY SPONSORED RESEARCH OR DEVELOPMENT

Not Applicable.

MICROFICHE/COPYRIGHT REFERENCE

Not Applicable.

FIELD OF THE INVENTION

This invention pertains to protective hoods, such as a protective hood worn by a firefighter or other emergency worker.

BACKGROUND OF THE INVENTION

Protective hoods, such as those used by firefighters are exemplified in U.S. Pat. Nos. 4,972,520; 5,090,054; 5,873,132; and 6,662,375, the disclosures of which are incorporated herein by reference, and are available commercially from Morning Pride Manufacturing, L.L.C. of Dayton, Ohio. Additionally, protective hoods are also used by others such as race car drivers, rescue workers and other emergency personnel.

It is common for a protective hood such as worn by firefighters and other emergency workers to be made from a knit material that stretches in the circumferential direction C around the head of the wearer for fit and ease of donning the hood, as shown in FIG. 1. However, because the knit material does not have the same ability to stretch in the longitudinal direction L, extra fabric will often remain at the crown of the head after it is donned, as seen in FIGS. 1 and 2. This extra material can become an irritant to a wearer, and/or interfere with other protective gear, such as a protective helmet.

SUMMARY OF THE INVENTION

A protective hood is provided for use by a firefighter or other emergency worker. The hood includes a crown portion to cover the top of a wearer's head, the crown portion being made from a material having a primary stretch direction oriented to extend in a transverse (ear-to-ear) direction across the top of a wearer's head; and a lower portion that extends downward from the crown portion, the lower portion being made from a material having a primary stretch direction oriented to extend in a circumferential direction around a wearer's head.

Other objects, features, and advantages of the invention will become apparent from a review of the entire specification, including the appended claims and drawings.

DETAILED DESCRIPTION OF THE PREFERRED EMBODIMENT

Figure 1:
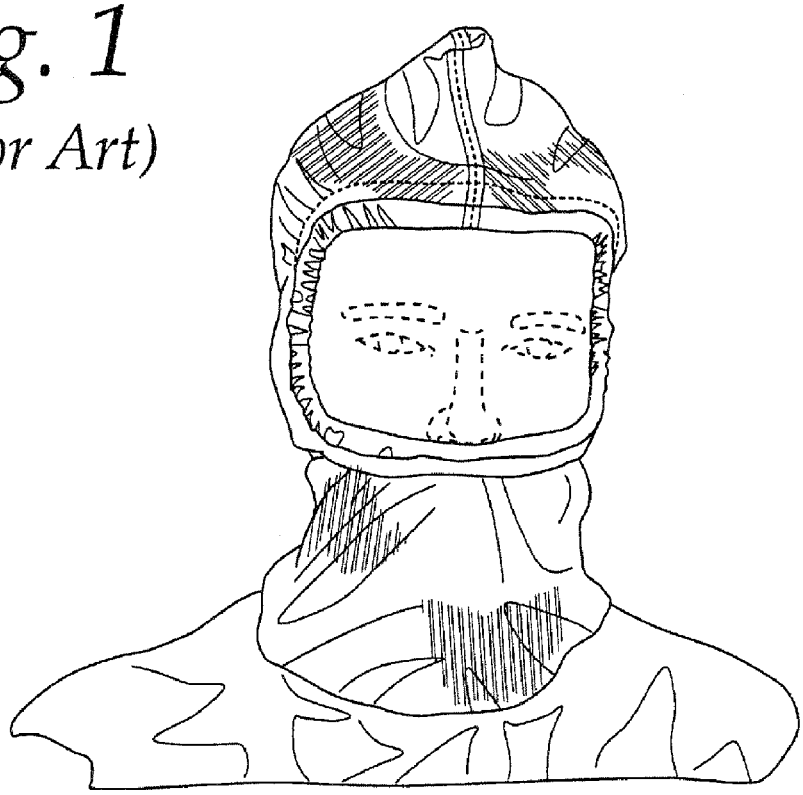
Fig. 1 (Prior Art)
FIG. 1 is a front perspective view of a prior art protective hood in a donned position on a wearer.
Figure 2:
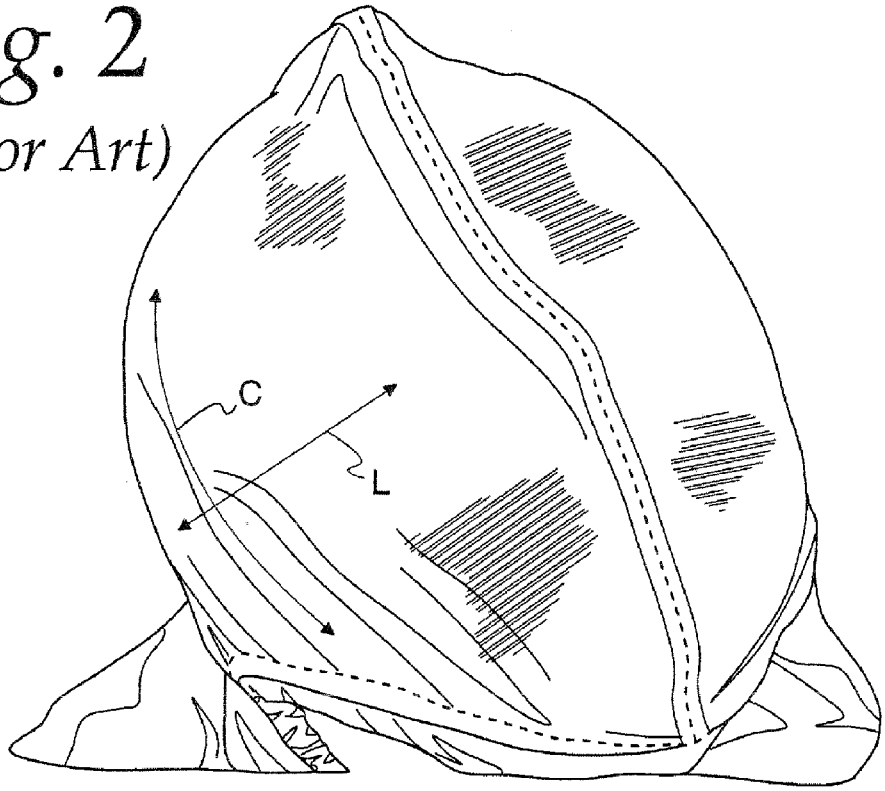
Fig. 2 (Prior Art)
FIG. 2 is a perspective view from above of the prior art protective hood and wearer of FIG. 1.
Figure 3:
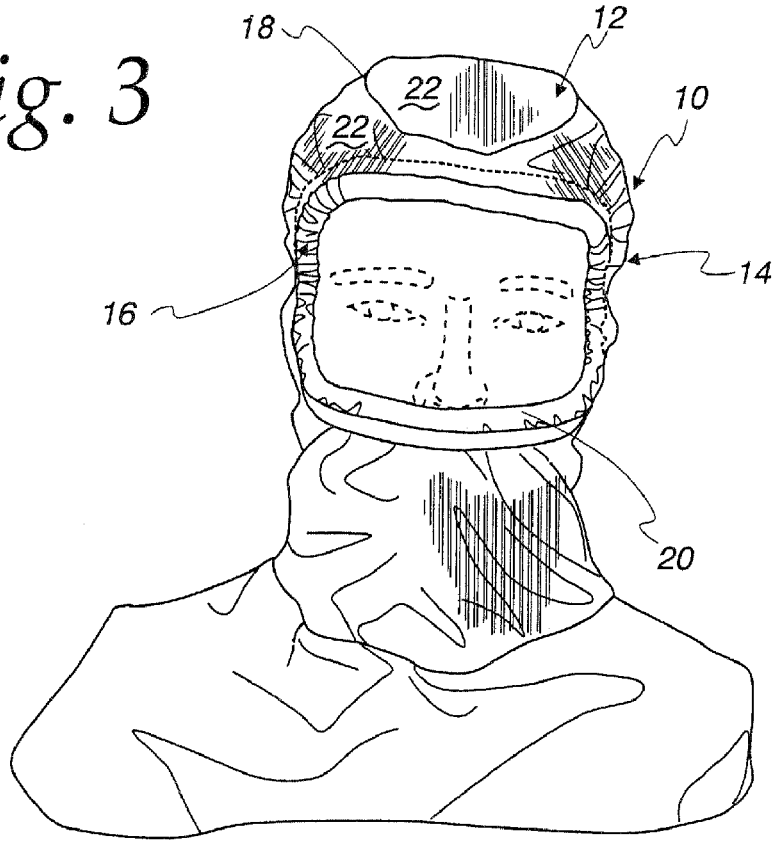
FIG. 3 is a front perspective view of a protective hood embodying the invention in a donned position on a wearer.
Figure 4:
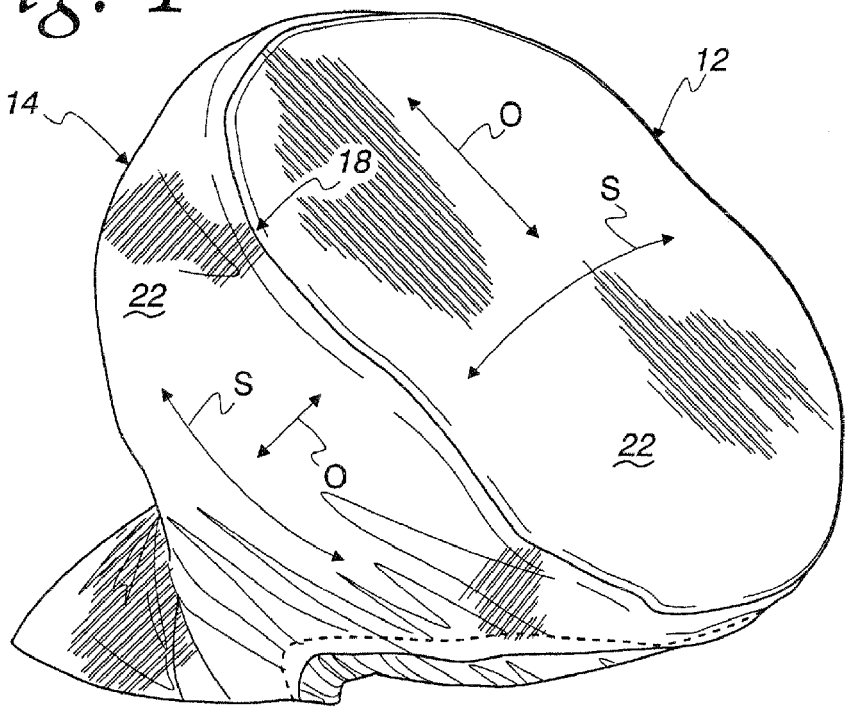
FIG. 4 is a perspective view from above of the protective hood and wearer of FIG. 3.

With reference to FIGS. 3 and 4, a protective hood 10 is provided and includes a crown portion 12 and a lower portion 14 extending downward from the crown portion 12 to preferably cover the back, sides, and front of a wearer's head with a window opening 16 for at least the eyes of the wearer. A circumferential seam 18 connects a perimeter of the crown portion 12 with the lower portion 14. The window opening 16 is preferably defined by a peripheral bead or seam 20 that can elastically expand to conform to shape of the wearer's face and a desired opening size.

The crown portion 12 and lower portion 14 are made from a knit material 22 that has a primary stretch direction S in which the material stretches relatively easily in comparison to an orthogonal direction O. As best illustrated in FIG. 4, the lower portion 14 is oriented so that the material 22 stretches circumferentially around the head, with the stretch direction S aliened circumferentially. The material 22 of the crown portion is rotated with respect to the orientation of the material 22 of the lower section so that the material 22 stretches transversely across the crown of the head. It should be appreciated that by providing the crown portion 12 that is stretchable in the transverse direction together with the lower portion 14 that is stretchable in a circumferential direction, the hood 10 can provide a good fit both the circumference of the head and the top of the head.

The knit material 22 can be made from a variety of materials known to those skilled in the art, including for example NOMEX® knit material. Preferably, the material 22 should be fire resistant and thermally insulative to protect the wearer.

The invention claimed is:

1. A protective hood, the hood comprising:

a crown portion to cover the top of a wearer's head, the crown portion being made from a material having a primary stretch direction oriented to extend in a transverse direction across the top of a wearer's head, the material's ability to stretch in the primary stretch direction being superior to the material's ability to stretch in a direction orthogonal to the primary stretch direction; and a lower portion that extends downward from the crown portion, the lower portion being made from a material having a primary stretch direction oriented to extend in a circumferential direction around a wearer's head, the material's ability to stretch in the primary stretch direction being superior to the material's ability to stretch in a direction orthogonal to the primary stretch direction.

2. The hood of claim 1 wherein an opening is provided in the lower portion for at least the eyes of a wearer.

3. The hood of claim 2 wherein the opening is defined by a peripheral seam that can elastically expand to conform to the shape of a wearer's face and a desired opening size.

4. The protective hood of claim 1 wherein the material of the crown portion is a knit material and the material of the lower portion is a knit material.

5. The protective hood of claim 1 wherein a circumferential seam connects a perimeter of the crown portion to the lower portion.

6. A protective hood, the hood comprising:

a crown portion to cover the top of a wearer's head, the crown portion being made from a knit material having a primary stretch direction oriented to extend in an transverse direction across the top of a wearer's head, the material's ability to stretch in the primary stretch direction being superior to the material's ability to stretch in a direction orthogonal to the primary stretch direction;

a lower portion that extends downward from the crown portion, the lower portion being made from a knit material having a primary stretch direction oriented to extend in a circumferential direction around a wearer's head, the material's ability to stretch in the primary stretch direction being superior to the material's ability to stretch in a direction orthogonal to the primary stretch direction; and an opening provided in the lower portion for at least the eyes of a wearer.

7. The protective hood of claim 6 wherein the opening is defined by a peripheral seam that can elastically expand to conform to the shape of a wearer's face and a desired opening size.

8. The protective hood of claim 6 wherein a circumferential seam connects a perimeter of the crown portion to the lower portion.

9. A protective hood, the hood comprising:

a crown portion to cover the top of a wearer's head, the crown portion being made from a material having a primary stretch direction oriented to extend in an transverse direction across the top of a wearer's head, the material's ability to stretch in the primary stretch direction being superior to the material's ability to stretch in a direction orthogonal to the primary stretch direction;

a lower portion that extends downward from the crown portion, the lower portion being made from a material having a primary stretch direction oriented to extend in a circumferential direction around a wearer's head, the material's ability to stretch in the primary stretch direction being superior to the material's ability to stretch in a direction orthogonal to the primary stretch direction, a circumferential seam connecting a perimeter of the crown portion to the lower portion; and an opening provided in the lower portion for at least the eyes of a wearer.

10. The protective hood of claim 9 wherein the opening is defined by a peripheral seam that can elastically expand to conform to the shape of a wearer's face and a desired opening size.

11. The protective hood of claim 9 wherein the material of the crown portion is a knit material and the material of the lower portion is a knit material.

* * * * *